US005249399A

United States Patent [19]

Aulson

[11] Patent Number: 5,249,399

[45] Date of Patent: Oct. 5, 1993

[54] LEAD-BASE PAINT PAINTED WOODWORK CONTROL ARRANGEMENT

[76] Inventor: Alan P. Aulson, 201 Pond St., Georgetown, Mass. 01833

[21] Appl. No.: 692,934

[22] Filed: Apr. 29, 1991

[51] Int. Cl.[5] ..... E06B 1/04

[52] U.S. Cl. ..... 52/211; 52/716.6

[58] Field of Search ..... 52/97, 211, 716, 718

[56] References Cited

U.S. PATENT DOCUMENTS

| | | | |
|---|---|---|---|
| 2,114,158 | 4/1938 | Vasbinder | 52/211 X |
| 3,130,455 | 4/1964 | Borlenghi | 20/11 |
| 3,443,345 | 5/1969 | Spencer | 52/211 |
| 3,478,478 | 11/1969 | Luebs | 52/309 |
| 4,193,238 | 3/1980 | Chalmers et al. | 52/211 |
| 4,341,048 | 7/1982 | Minter | 52/211 |
| 4,391,072 | 7/1983 | Moore | 52/211 |
| 4,492,062 | 1/1985 | Levenez | 52/97 |
| 4,652,451 | 7/1987 | Hubble | 52/97 |
| 4,843,790 | 7/1989 | Taravella | 52/211 |

*Primary Examiner*—Carl D. Friedman
*Assistant Examiner*—Beth A. Aubrey
*Attorney, Agent, or Firm*—Don Halgren

[57] ABSTRACT

An arrangement for safely covering lead-base paint painted trim surfaces typically found in older homes, by determining and recording the measurement and shape of the lead-base paint painted trim such as woodwork consisting of doorframes, window frames of the like, and cutting and shape forming to the trim's shape a sheet of 20-gauge sheet aluminum. The shaped metal component is applied to the offending trim after a bead of adhesive has been applied thereto. Typically the metal component is of a U-shaped configuration, so as to cover the exposed 3 sides of the trim's surface.

5 Claims, 3 Drawing Sheets

LEAD-BASE PAINT PAINTED WOODWORK CONTROL ARRANGEMENT

BACKGROUND OF THE INVENTION (1) Field of the Invention

This invention relates to systems for the control of lead based paint on woodwork of homes, and more particularly to apparatus and method for covering woodwork painted with a lead based paint in homes and apartments.

(2) Prior Art

Lead poisoning poses a terrible environmental threat, particularly for young people. Levels of 25 micrograms of lead per deciliter of blood, if maintained in young children, can affect mental capacities and result in grave behavioral and physical problems.

About 3 million to 4 million American children, or about 1 out of every 6 under six years old, have lead poisoning. While only 7% of young children from medium income families are afflicted, about 25% of poor white children and an incredible 55% of those from low income minority families.

The United States Department of Health and Human Services warns that even moderate exposure to lead can be more pervasive and long lasting than previously thought. Government regulations have already phased out most leaded gasolines. Lead-based paints have been banned for most uses since 1977. However, a 1988 Public Health Service report revealed that 52%, or 42 million of the nation's households have layers of lead-based paint on their woodwork.

Lead is highly toxic even in minute quantities. Once it is ingested, lead enters the bloodstream, where it inhibits the production of hemoglobin which red blood cells need to carry oxygen. It also locks onto essential enzymes in the brain and central nervous system to inactivate them. Symptoms of lead poisoning include abdominal pains, muscular weakness and fatigue; severe exposure can cause nervous system disorders, high blood pressure and even death.

Small children have the greatest risk because their nervous systems and brains are still developing. Lead can be removed from humans by a process doctors call chelation, using drugs that bind to the metal in the bloodstream, and flush it out in the urine, if treatment is begun before too much damage is done.

However, medical treatment is no substitute for a safe environment. The Health and Human Services plan calls for (1) surveillance of children with elevated levels of lead in their blood; (2) elimination of leaded paint and contaminated dust in housing; (3) reduction of children's exposure to lead in food, air, soil and water; and (4) an increase in community programs for the prevention of childhood lead poisoning. Eliminating lead from all pre-1950 housing would save as much as $28 billion in medical expenses and other costs, but at an expense of about $10 billion to put this plan into effect over the next 10 years.

Eliminating the lead problem by painted encapsulants is a current hope of researchers at the University of Lowell in Lowell, Mass. Acrylic, polyester and epoxy are the planned materials which might be painted upon the lead paint surface where they will hopefully dissolve the paint and cross link with it onto the wood or plaster below. The goal appears to be to interlock the materials. Some of the tests done on the treated surfaces will include impact resistance. When you hit it, does it chip and produce lead dust? Abrasion and adhesion tests are also important, as will be aging tests to see how long the coating will last and what effect heat, light and household cleaners might have on it. The encapsulants will have to be developed, and of course, pass these aforementioned tests.

U.S. Pat. No. 4,391,072 to Moore entitled "Window Trim" describes a homeowner installable molded fiberglass for modifying the appearance of a window sill and jamb components, which is unsatisfactory for effective long term control of lead paint pollution.

U.S. Pat. No. 3,443,345 to Spencer shows an extruded rigid vinyl plastic cover for wood trim which is nailable to the wood through flapped grooves, which unfortunately creates openings through the covering, and also necessitates the disposition of grooves in the wood trim in which the cover groove must mate. The grooves can actually facilitate the release of the lead based paint.

U.S. Pat. No. 3,478,478 to Luebs shows an extruded, snap-on plastic cover for glass glazing or for particular trim components, to change their appearance, which does not however solve the lead paint problem on the woodwork, since this is merely a retainer for the glazing.

U.S. Pat. No. 3,130,455 to Borlenghi shows an extruded plastic door frame which covers bridging wood and forms a door case which permits new construction to be given a finished appearance with a plastic cover. This type of cover is susceptable to wear and damage long before any of the covering contemplated by the present invention.

U.S. Pat. No. 4,843,790 shows a casing trim of extruded thin siding vinyl including interlocking edges and nailed trim grooves for supporting the vinyl on the wood, again suffering from the same deficiencies of the other art.

The prior art trim covering, none of which is used for lead based paint control, is made by extruded or formed plastic, the use of which is only a short term solution, which plastic covering is subject to wear, cracking, sun or heat degradation and toxicity if combusted, and which shortcomings are all avoided by the present invention. Dust, particles and contaminants covered by Applicant's concept are safely and permanently excluded from the atmosphere, and from any possibility of being ingested by children.

BRIEF SUMMARY OF THE INVENTION

The present invention relates to a novel arrangement for covering lead-base paint painted surfaces such as wood, which surfaces are typically found in homes and apartments, which novel arrangement will stand up to wear, abuse, and rough children without disturbing the lead paint underneath, and without creating the possibility of paint dust or paint contamination. The present invention provides a covering of lead painted wood surfaces in a manner not shown or suggested by the prior art, and is superior to any other treatment or apparatus for dealing with lead-base paint painted trim surfaces.

The present invention critically comprises an arrangement of pre-measured and pre-formed metal components which adaptively fit over the components of the lead based painted surfaces such as wood, after a bead of adhesive has been applied thereto. The cover components are critically pre-fabricated from 0.032 inch thick metal sheets (20 gauge) of aluminum, which is selected for being thick and strong enough to withstand abuse without breaking apart while still being able to be formed on a metal shaping machine to the general surface characteristics of the lead based paint form to which it is to be applied.

The lead based paint painted (generally wood) trim and frame portions of windows and doors are the most conspicuous lead painted surfaces which create the chipping lead paint problem and which are the most likely for children to come into contact with. Those lead painted trim and frame portions are measured for their size and identified for their shape and surface characteristics. The 20 gauge sheet metal is then cut and fabricated in a known manner, so as to conform to the dimensions and surface characteristics of the lead-base paint painted trim and frames being covered.

Each lead-base paint painted trim and frame to be covered is then given a surpentine bead of adhesive with which to secure the shaped metal cover. Each shaped metal cover is generally a channel of "U"-shaped cross section that extends around at least three sides of the lead-base paint painted trim and frame portions being treated.

It is therefore an object of the present invention to provide a strong, durable, long-lasting arrangement for the inexpensive elimination of lead-base paint problems associated with trim (wood) and frames (wood) typically found in older homes and apartments in the United States today.

It is a further object of the present invention to provide an arrangement for eliminating lead paint problems without creating problems of sanding or generation of lead-fouled dust in treating these trim and frame elements, and without disturbing these lead-painted surfaces at all, thus complying with United States Housing and Urban Development Interim Guidelines for lead-based paint.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
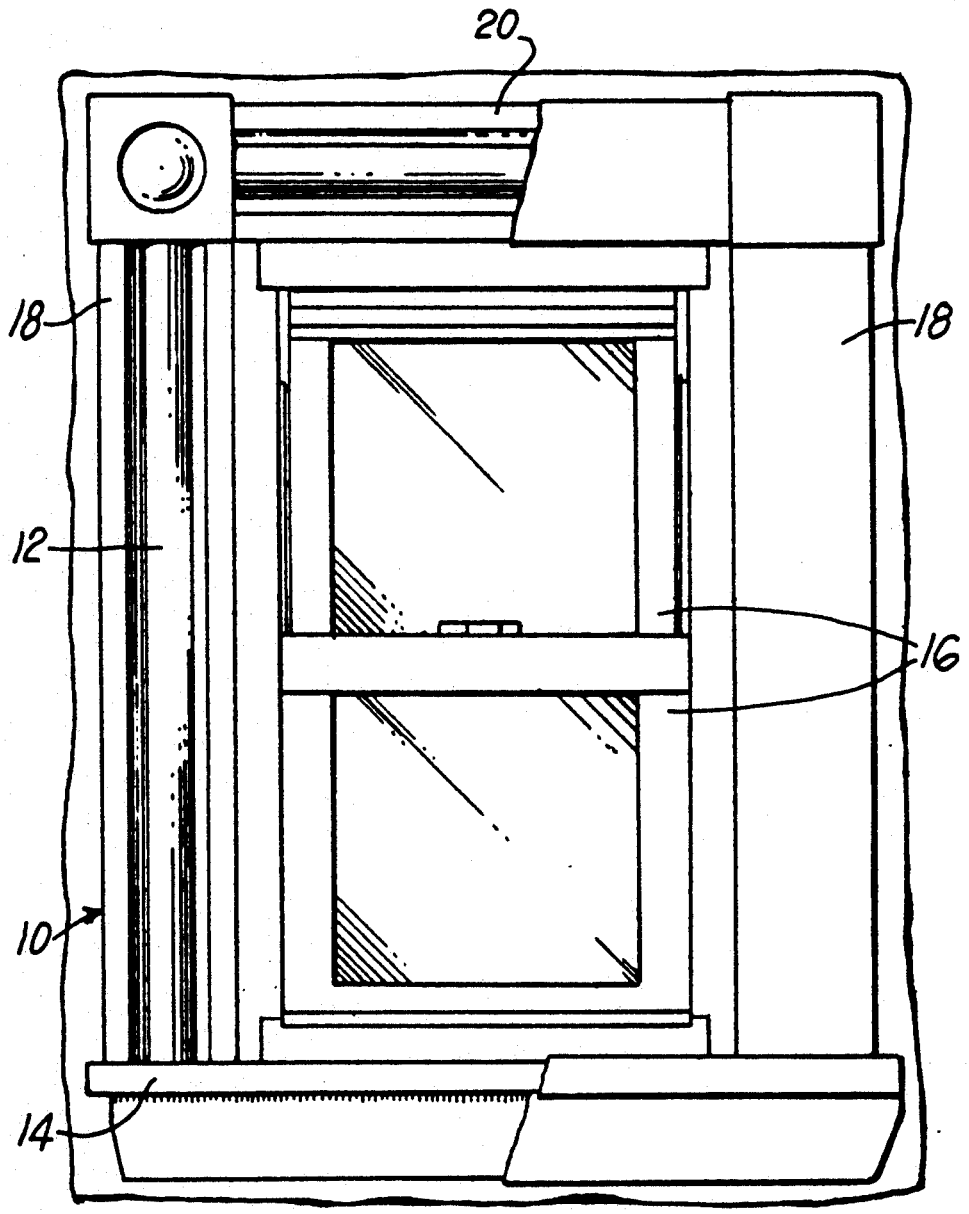
FIG. 1 is an elevational view of a window frame and sash showing the frame and its sill partially covered by the present invention.

Referring now to the drawings in detail, and particularly to FIG. 1, there is shown a window assembly 10 comprising a lead painted window frame 12, typically constructed of wood, including a window sill 14 and an arrangement of sashes 16. The window frame 12 includes vertical components 18 and 20. In accordance with the present invention, the length, width, edge dimensions and shape characteristics would be measured and recorded. The dimensions in turn would be fed into a metal cutting machine in a known manner, to permit a sheet metal worker to cut and trim flat sheet metal (critically 20-gauge sheet aluminum) into the proper outline. The sheet metal worker would then put the trimmed and cut 20-gauge sheet metal in a known manner into a sheet metal forming machine, in this example called a brake former, not shown, to form any bends, corners or curved surfaces necessary in the sheet metal components.

A typical window sill measuring 30 inches wide would be covered from a piece of 20-gauge aluminum, 30 inches wide, having notches in the upper corners matching whatever the dimension the vertical window frame measures. The 20-gauge piece of aluminum would then be formed on the brake former machine in a known manner for subsequent attachment to the lead-base paint painted window sill. The ends of the formed 20-gauge cover piece at the ends of the sill or gaps between the cover piece and the painted surface may be filled in with a fiberglass epoxy to fully seal in the lead-based painted surface and to provide a smooth appearance at corners of the sheet metal component after attachment of the sheet metal to the sill. When measuring the 20-gauge aluminum sheet to fit over a particular size piece of trim such as wood, an increase in dimension of about one-eighth of an inche must be allowed to permit the 20-gauge piece of aluminum to properly mate over the trim.

After the aluminum sheets have been cut, trimmed and formed, the 20-gauge aluminum sheet metal components would then be transported to the site having the offending lead painted trim on its windows and door frames.

Figure 2:
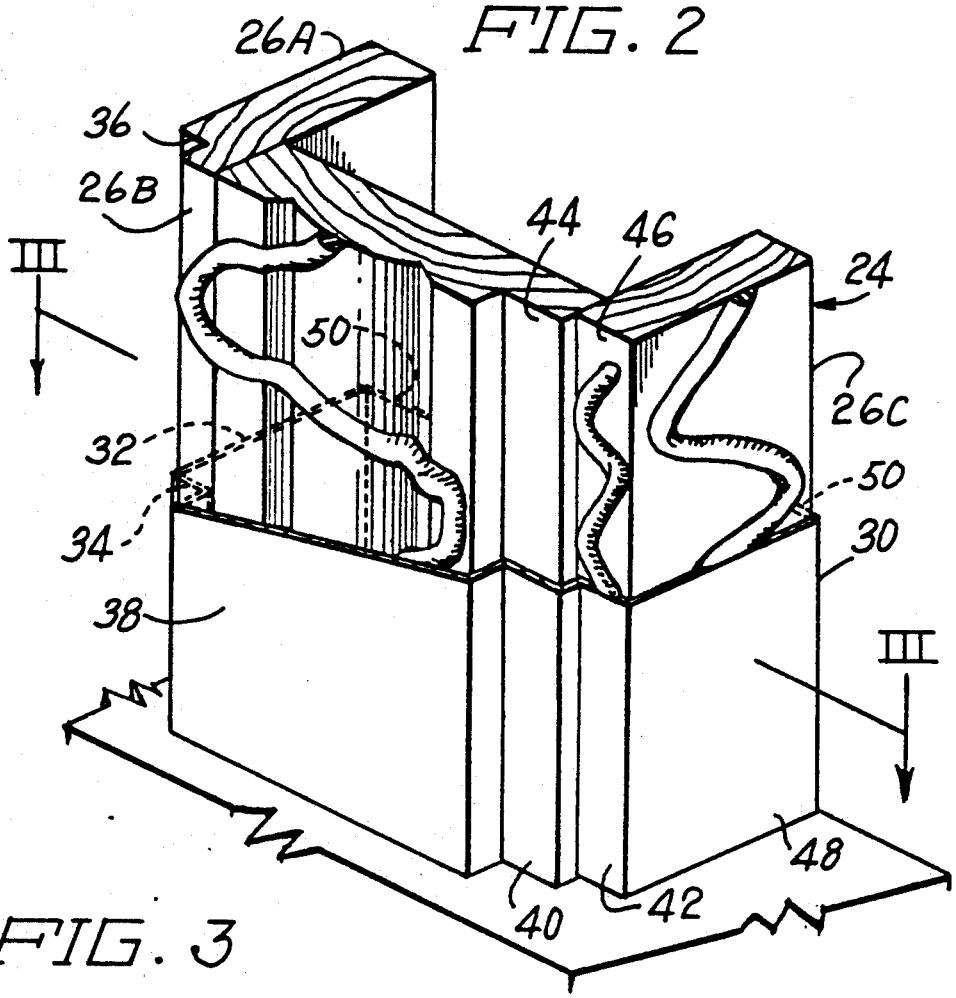
FIG. 2 is a partial perspective view of a frame of a door normally attached to a wall, having a cutaway of the present invention.

A typical door frame 24 of U-shape, having three surface boards 26A, 26B and 26C, is shown in FIG. 2 having a serpentine bead of adhesive 22 placed on the outer side of each board 26A, 26B, 26C by a final finish assembly worker.

Figure 3:
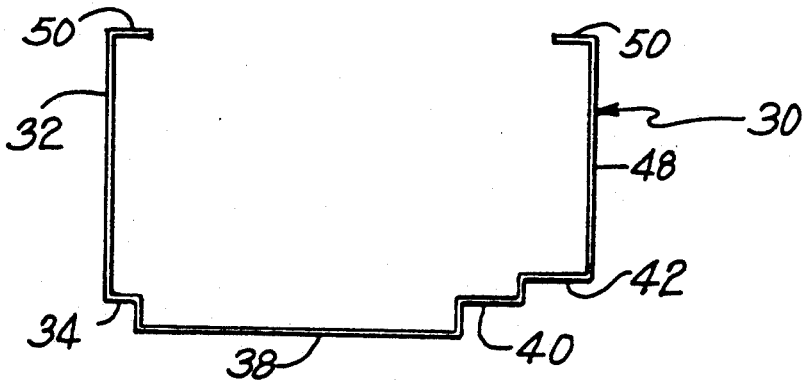
FIG. 3 is a view taken along the lines III—III of FIG. 2.
Figure 4:
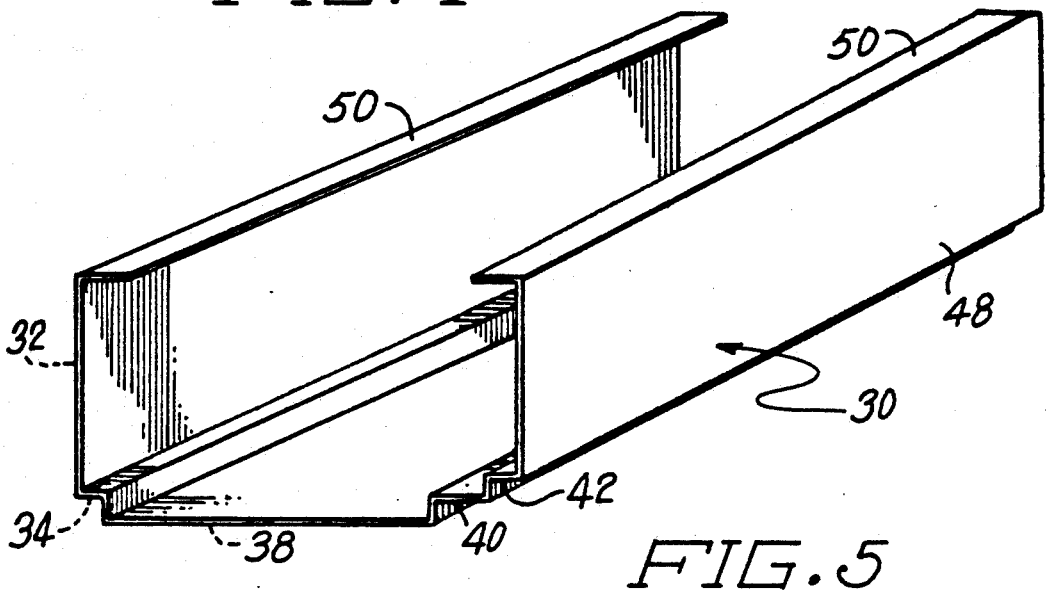
FIG. 4 is a perspective view of the formed cover of FIGS. 2 and 3, before it is applied to a lead-base paint painted element.

Critically then, a cut, trimmed and formed component 30 of 20-gauge (0.032 inch aluminum) sheet metal, typically of "U"-shape in cross-section, shown partially in FIG. 2, is mated over the door frame 24. The formed component 30 is shown, in an edge view in FIG. 3, and in an exemplary perspective view in FIG. 4. Each formed component 30 of 20-gauge formed sheet aluminum is generally of U-shape, but may not be, depending on the shape and features of the lead painted wood trim being covered. The formed component 30 shown in FIG. 3 has a first face 32 corresponding to the outer surface of board 26A, a shoulder 34 corresponding to the shoulder 36 in the edge of board 26A shown in FIG. 2; a second face 38 corresponding to the outer surface of board 26B shown in FIG. 2; a pair of stepped shoulders 40 and 42 corresponding to the shoulders 44 and 46 between boards 26B and 26C shown in FIG. 2; and a third face 48, corresponding to the outer surface of the board 26C, shown in FIG. 2. Each component 30 may have a formed edge 50, corresponding to the thickness of the boards 26A and 26C.

It is to be noted that the formed components may have one surface which could be curvilinear, such as the outer edge of a window sill. It is generally typical that each formed metal component will be of U-shaped configuration to at least cover all exposed lead painted surfaces of the window trim or door frame being covered. It is critical to this invention that the formed components be manufactured from 20-gauge (0.032-inch thick) sheet metal, such as aluminum. This is important because only sheet metal can be formed on a sheet metal forming machine. Metal will resist burning and giving off toxic fumes if there were a fire in that building. Metal will long outlast plastic, is not toxic and will not break.

Figure 5:
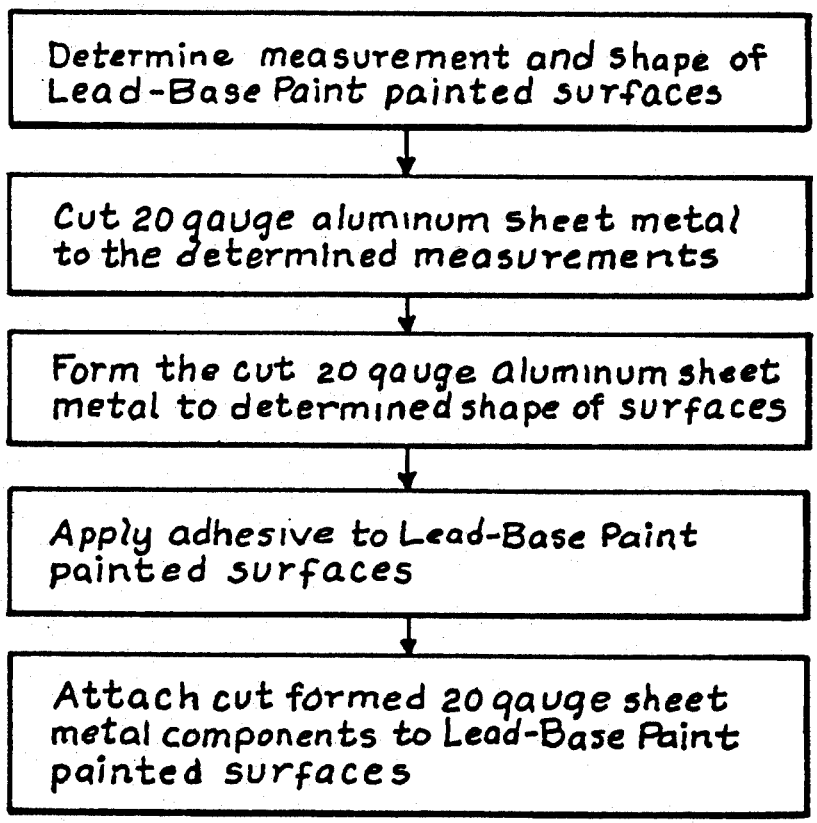
FIG. 5 is a block diagram showing the steps taken in the application of the present invention.

The steps of this invention are shown in FIG. 5, reciting (A) Determining Measurements including the size, length, width, thickness and the shape of the lead painted trim; (B) Cutting to size the 20-gauge aluminum sheet metal; (C) Forming in a sheet metal forming machine the 20-gauge aluminum sheet metal; (D) Applying a bead of adhesive to the lead-painted surface (typically wood); (D) Applying the cut, formed 20-gauge aluminum sheet metal component to the lead based painted surface.

Thus what has been shown is a unique arrangement for eliminating dangers found in lead base painted surfaces common in many U.S. homes and apartments today. This invention eliminates the problem, without requiring residents already living there to move out, because no disturbance to the lead-base paint painted surfaces will take place. The offending surfaces will be safely covered up by a component that will not melt or burn in usual circumstances, that will stand up to abusive treatment and be harmless to children who are the most likely ones to come in close contact with it.

I claim:

1. A formed metal arrangement for covering up and eliminating lead problems associated with lead-base paint painted interior wood trim surfaces without disturbing those lead-base paint painted trim surfaces, by an enclosure means adaptable over said interior painted trim surfaces;

said enclosure means comprising a shaped sheet metal component having dimensions large enough to cover the painted trim and fit over the trim inside a house or appartment, completely encapsulating said wood trim preventing lead from escaping; and wherein said sheet metal component is comprised of aluminum sheet metal of 20-gauge thickness.

2. An arrangement for covering up and eliminating lead problems associated with lead-base paint painted trim surfaces as recited in claim 1, wherein said shaped 20- gauge sheet metal has a form which conforms to the shape of the surface being covered.

3. A method of eliminating problems of lead-base paint painted trim surfaces, without causing dust or potentially toxic fumes typically associated with non-metallic covering of such surfaces, comprising the steps of:

determining measurement and shape of such lead-base paint painted surfaces in a house or apartment;

cutting a 20-gauge thick piece of aluminum sheet metal according to said measured dimensions of said surfaces;

forming said cut sheet metal according to the shape of said surfaces so as to have it conform thereto, completely encapsulating said wood trim preventing lead from escaping;

applying a bead of adhesive to the surfaces to be covered by said cut, formed sheet metal component; and attaching said cut, shape formed 20-gauge thick sheet metal component to said surfaces.

4. A method as recited in claim 3, wherein said sheet metal is aluminum.

5. A method as recited in claim 4, wherein a fiberglass epoxy is applied to any gaps between said surfaces and said formed metal component to sealingly enclose said lead-base paint within said formed metal component.

* * * * *